US012253095B2

(12) United States Patent
Yestrepsky et al.

(10) Patent No.: US 12,253,095 B2
(45) Date of Patent: Mar. 18, 2025

(54) BLOWER DEVICE

(71) Applicant: VALEO SYSTEMES THERMIQUES, La Verriere (FR)

(72) Inventors: Jonathan Yestrepsky, Auburn Hills, MI (US); Jonathan Atwater, Auburn Hills, MI (US); Andrew Eggebroten, Auburn Hills, MI (US)

(73) Assignee: Valeo Systemes Thermiques, La Verriere (FR)

( * ) Notice: Subject to any disclaimer, the term of this patent is extended or adjusted under 35 U.S.C. 154(b) by 39 days.

(21) Appl. No.: 18/166,054

(22) Filed: Feb. 8, 2023

(65) Prior Publication Data

US 2024/0263641 A1 Aug. 8, 2024

(51) Int. Cl.

| | |
|---|---|
| ***F04D 29/42*** | (2006.01) |
| ***F04D 17/16*** | (2006.01) |
| ***F04D 25/06*** | (2006.01) |
| ***F04D 25/08*** | (2006.01) |
| ***F04D 29/28*** | (2006.01) |
| ***F04D 29/58*** | (2006.01) |
| ***F04D 29/70*** | (2006.01) |

(52) U.S. Cl.

CPC ..... *F04D 29/4226* (2013.01); *F04D 17/16* (2013.01); *F04D 25/06* (2013.01); *F04D 25/082* (2013.01); *F04D 29/281* (2013.01); *F04D 29/4206* (2013.01); *F04D 29/5806* (2013.01); *F04D 29/5813* (2013.01); *F04D 29/703* (2013.01)

(58) Field of Classification Search

CPC .... F04D 29/5806; F04D 25/082; F04D 25/06; F04D 17/16; F04D 29/281; F04D 29/4206; F04D 29/5813; F04D 29/4226

See application file for complete search history.

(56) References Cited

U.S. PATENT DOCUMENTS

| | | | | |
|---|---|---|---|---|
| 6,107,708 | A * | 8/2000 | Yamaguchi | H02K 9/06 310/58 |
| 6,528,919 | B2 | 3/2003 | Fujii et al. | |
| 7,575,421 | B2 | 8/2009 | McAuliffe et al. | |

(Continued)

FOREIGN PATENT DOCUMENTS

| | | |
|---|---|---|
| GB | 2495710 A | 4/2013 |
| JP | 2004040935 A | 2/2004 |
| JP | 2018107956 A | 7/2018 |

OTHER PUBLICATIONS

European Patent Office, International Search Report and Written Opinion of corresponding International Application No. PCT/EP2024/052952, dated Apr. 25, 2024.

*Primary Examiner* — Peter J Bertheaud

(74) *Attorney, Agent, or Firm* — Valeo Systemes Thermiques

(57) ABSTRACT

A blower device including: a motor holder having an opening; a motor housed within the motor holder; a blower fan coupled to the motor; an electronic circuit adapted to control the motor. The motor holder includes an air inlet and an air channel configured to supply the electronic circuit and the motor with an airflow from the air inlet. The air channel includes a first deflector wall and a first liquid trap wall arranged in series between the air inlet and the electronic circuit. The first deflector wall and the first liquid trap wall extend in opposite directions and form a meandering path for the airflow.

17 Claims, 4 Drawing Sheets

(56) References Cited

U.S. PATENT DOCUMENTS

| | | | | |
|---|---|---|---|---|
| 8,096,760 | B2 * | 1/2012 | Kuma | F04D 29/5806 415/208.2 |
| 2017/0058903 | A1 | 3/2017 | Motomura | |

* cited by examiner

BLOWER DEVICE

TECHNICAL FIELD

The object of the invention is a blower device, in particular a blower device applicable for an HVAC (heating, ventilation and air conditioning) system, for example in an automotive field.

BACKGROUND OF THE INVENTION

Blower devices are commonly used in HVAC (heating, ventilation and air conditioning) systems to ensure desired airflow through various components, for example heat exchangers and supply channels, so that air of specific parameters can reach selected destinations. A blower device includes a motor propelling a blower fan attached thereto. An electronic circuit can be incorporated into the blower device to control operation of the motor.

The motor, and in some cases the electronic circuit, can require cooling in order maintain optimal conditions for operation. One of ways to cool these components is to provide an arrangement which will force airflow around them. It can happen, especially in automotive application, that this airflow will include liquid, e.g. water droplets, which can endanger elements present on its path. As is well known, liquid such as water is detrimental to operation to any electric component.

It would be desirable to provide a blower device with subcomponents cooled by means of air, which could ensure proper operation even in case of presence of liquid within the cooling airflow.

BRIEF SUMMARY OF THE INVENTION

The object of the invention is a blower device comprising: a motor holder; a motor housed within the motor holder; a blower fan coupled to the motor; an electronic circuit adapted to control the motor; wherein the motor holder includes an air inlet and an air channel configured to supply the electronic circuit and the motor with an airflow from the air inlet, wherein the air channel includes a first deflector wall and a first liquid trap wall arranged in series between the air inlet and the electronic circuit, wherein the first deflector wall and the first liquid trap wall extend in opposite directions and form a meandering path for the airflow.

In one embodiment, the first deflector wall is situated upstream from the first liquid trap wall.

In one embodiment, the air channel includes a bottom portion, the first liquid trap wall extending upwards from the bottom portion so as to form a liquid trap for liquid present in the airflow entering the air inlet.

In one embodiment, the first deflector wall extends downwards from the motor holder, within the air channel, towards the bottom portion.

In one embodiment, the bottom portion and the first deflector wall form an oblique angle.

In one embodiment, the bottom portion and the first deflector wall form a right angle.

In one embodiment, the motor holder includes a first motor holder part and a second motor holder part releasably attached to each other and both forming the air channel, the first motor holder part encapsulating the motor, wherein the bottom portion is part of the second motor holder part.

In one embodiment, the air inlet includes a connection flange.

In one embodiment, the connection flange is in form of an insert attached within the air inlet.

In one embodiment, the first deflector wall protrudes from the connection flange.

In one embodiment, the connection flange includes a drain slot configured to allow liquid flow into the air channel.

Preferably, the blower device further comprises a second deflector wall extending within the air channel and contributing to the meandering path for the airflow.

In one embodiment, the second deflector wall is adjacent to the electronic circuit and is protruding farther than the first deflector wall so that the distance between the terminal end of the first deflector wall and the bottom portion is smaller than the distance between the electronic circuit and the bottom portion.

In one embodiment, the motor holder includes a first motor holder part and a second motor holder part releasably attached to each other, wherein the bottom portion is part of the second motor holder part, wherein the second deflector wall protrudes from the first motor holder part.

Preferably, the blower device further comprises a second liquid trap wall extending within the air channel and contributing to the meandering path for the airflow.

In one embodiment, the motor holder includes a first motor holder part and a second motor holder part releasably attached to each other, wherein the bottom portion is part of the second motor holder part, wherein the second liquid trap wall protrudes from the second motor holder part.

Preferably, the blower device further comprises a third deflector wall extending within the air channel and contributing to the meandering path for the airflow.

In one embodiment, the motor holder includes a first motor holder part and a second motor holder part releasably attached to each other, wherein the bottom portion is part of the second motor holder part, wherein the third deflector wall protrudes from the first motor holder part.

In one embodiment, the third deflector wall is adjacent to the electronic circuit and is protruding farther than the first deflector wall so that the distance between the terminal end of the third deflector wall and the bottom portion is smaller than the distance between the electronic circuit and the bottom portion.

BRIEF DESCRIPTION OF THE DRAWINGS

The present invention will be described in greater detail below with reference to the drawings. In the drawings.

DETAILED DESCRIPTION OF THE INVENTION

Figure 1:
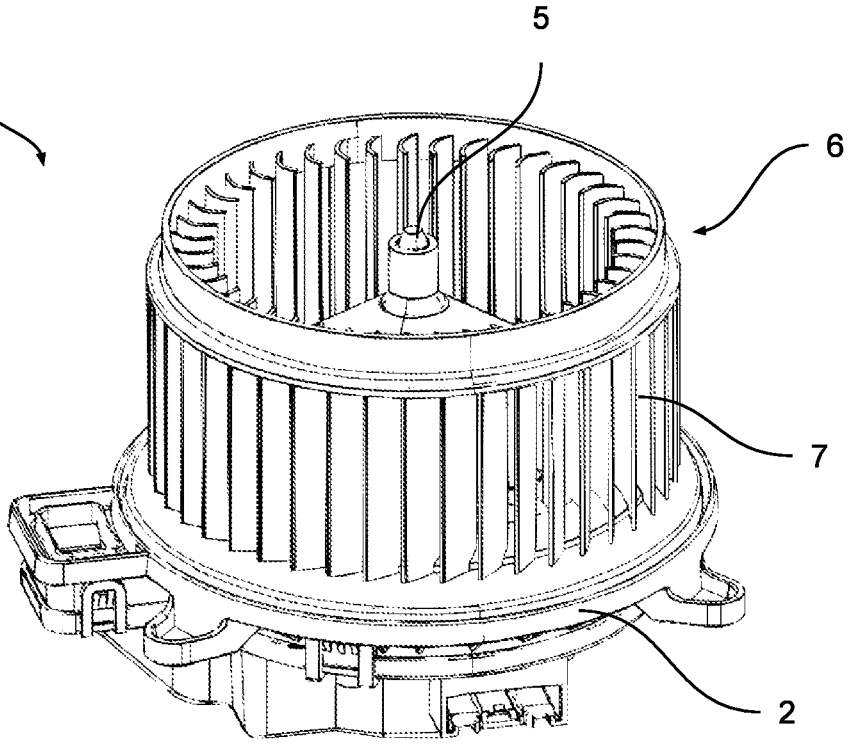
FIG. 1 shows a blower device according to an embodiment.

FIG. 1 shows a blower device 1. The blower device 1 according to the invention can be used in an HVAC system in order to ensure desired airflow, for example in an automotive application.

Figure 3:
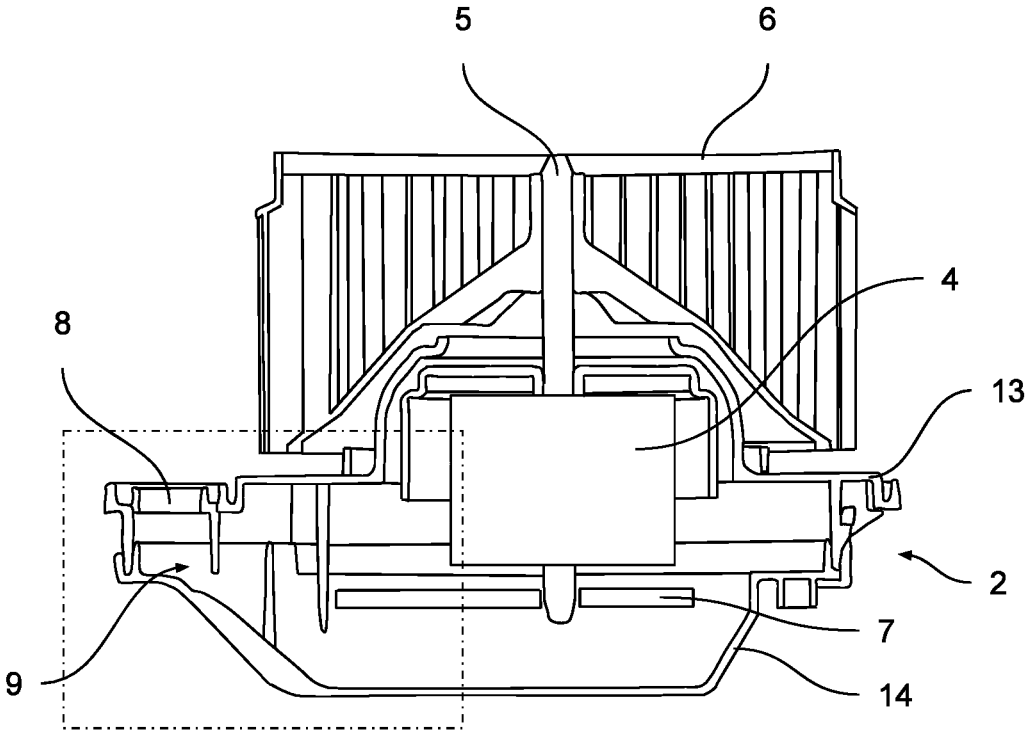
FIG. 3 shows a cross-sectional view of the blower device of FIG. 1.

The blower device 1 includes a motor holder 2, from which protrudes a shaft 5 connected with a motor 4 (as seen in FIG. 3). A blower fan 6 is mounted onto the shaft 5. The blower fan 6 includes a plurality of individual blades 7. A rotation center of the blower fan 6 is coupled to the motor 4, while the lower end of the blower fan 6 faces the motor holder 2.

Figure 2:
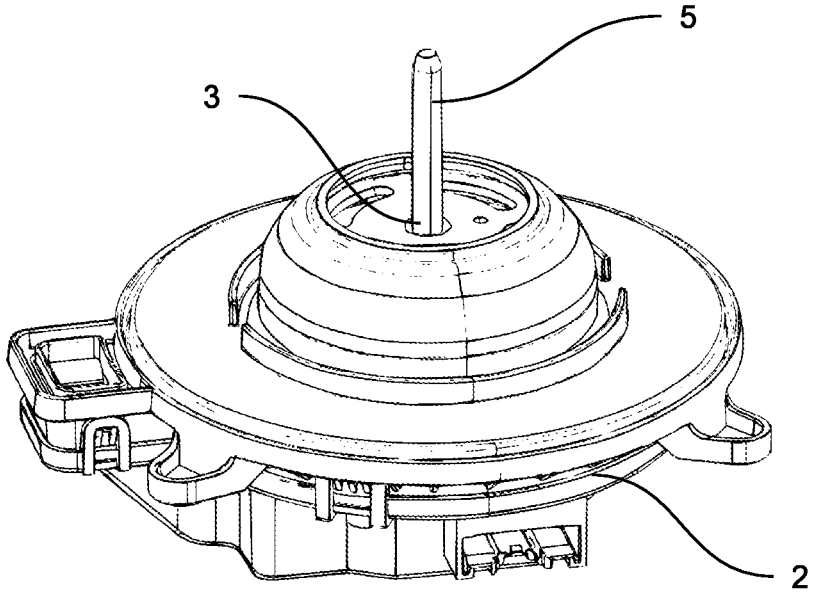
FIG. 2 shows a blower device of FIG. 1 without the blower fan.

FIG. 2 shows the blower device 1 of FIG. 1 without the blower fan 6. The motor holder 2 includes an opening 3 through which the shaft 5 of the motor 4 can protrude.

The blower device 1 is intended to be mounted so that the bottom of the motor holder 2 is the lowest portion, while the blower fan 6 is the highest portion with respect to the ground. The shaft 5 of the motor 4 can be substantially vertical with respect to the ground.

Figure 4:
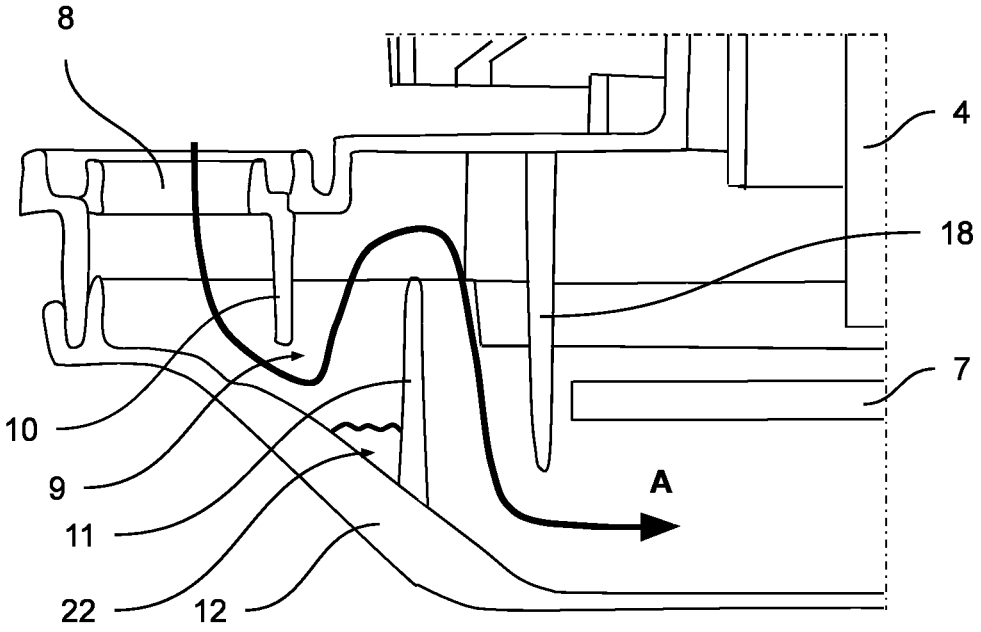
FIG. 4 shows an enlarged portion of the cross-sectional view of FIG. 3.

FIG. 3 shows a cross-sectional view of the blower device of FIG. 1, while FIG. 4 shows an enlarged portion of the cross-sectional view of FIG. 3. The motor 4 is housed within the motor holder 2. The motor 4 can be a DC commutator motor with a field induced from a permanent magnet. The motor holder 2 can include a first motor holder part 13 and a second motor holder part 14 connected to each other. Inside the motor holder 2 there is housed an electronic circuit 7 adapted to control the motor 4.

The motor 4, as well as the electronic circuit 7, can require dedicated cooling to ensure proper operation. For this reason, the motor holder 2 includes an air inlet 8 and an air channel 9 configured to supply the electronic circuit 7 and the motor 4 with an airflow A from the air inlet 8. The motor 4 thus is enabled to receive the airflow A for cooling, for example after it passes the electronic circuit 7, or in parallel.

The air channel 9 includes a first deflector wall 10 and a first liquid trap wall 11 arranged in series between the air inlet 8 and the electronic circuit 7. The air channel 9 is formed by the motor holder 2. Preferably, the air channel 9 is formed by the first motor holder part 13 and the second motor holder part 14. The air channel 9 can include a bottom portion 12. The bottom portion 12 can be a walled section of the motor holder 2 shaped so as to form part of the air channel 9. The bottom portion 12 is understood as the part of the motor holder 2 generally at the opposite side of the motor 2 and the electronic circuit 7. The first deflector wall 10 can extends downwards from the motor holder 2, within the air channel 9, towards the bottom portion 12.

The first deflector wall 10 and the first liquid trap wall 11 extend in opposite directions and form a meandering path for the airflow A. By the term "meandering" what is meant here is that the airflow A follows a winding course, for example changing its substantial direction at least twice. In one embodiment, the first deflector wall 10 is situated upstream from the first liquid trap wall 11. In any case, the first deflector wall 10 is intended to guide the airflow A and any liquid, e.g. water droplets, present therein towards the area in vicinity of the base of the first liquid trap wall 11. Such arrangement facilitates entrapment of the liquid and prevention of its escape further towards the subsequent section of the air channel 9, in particular where the electronic circuit 7 and the motor 2 are located.

The first liquid trap wall 11 can extend upwards from the bottom portion 12 so as to form a liquid trap 22 for liquid present in the airflow A entering the air inlet 8. In other words, any liquid present in the airflow A can be trapped by the bottom portion 12 and the first liquid trap wall 11 before it reaches the electronic circuit 7.

The first motor holder part 13 and a second motor holder part 14 can be attached to each other in a releasable manner. The first motor holder part 13 and a second motor holder part 14 can both be forming the air channel 9. The first motor holder part 13 can predominantly, or completely, encapsulate the motor 4, while the bottom portion 12 can be a part of the second motor holder part 14. The electronic circuit can be predominantly, or completely, housed within the second motor holder part 14.

In the embodiment shown in FIGS. 1 to 5, the bottom portion 12 and the first deflector wall 10 form an oblique angle. Such angled configuration can aid creation of the liquid trap 22 and its ability to retain the liquid.

The blower device 1 further includes a second deflector wall 18 extending within the air channel 9 and contributing to the meandering path for the airflow A. The second deflector wall 18 protrudes from the first motor holder part 13. As it protrudes in the direction opposite to the first liquid trap wall 11, it can shield any element subsequent element on the airflow's A path from any liquid present in it, and direct it downwards. The second deflector wall 18 can also deflect the airflow A towards the electronic components that need to be cooled. Advantageously, the second deflector wall 18 is adjacent to the electronic circuit 7 and is protruding farther than the first deflector wall 10 so that the distance between the terminal end of the first deflector wall 10 and the bottom portion 12 is smaller than the distance between the electronic circuit 7 and the bottom portion 12. These distances can be measured along paths parallel to the rotation axis of the shaft 5 of the motor 4.

Figure 5:
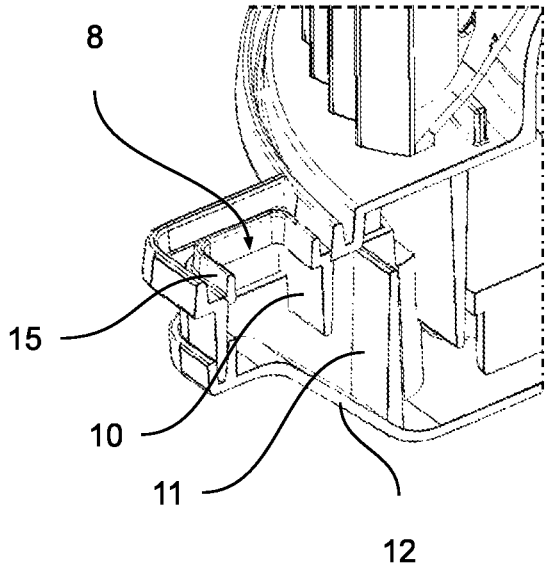
FIG. 5 shows a partial cross-section of blower device as shown in FIG. 4 in perspective view.

FIG. 5 shows a partial cross-section of blower device as shown in FIG. 4 in perspective view. The air inlet 8 includes a connection flange 15, onto which an external source of airflow can be attached, for example coming from an HVAC assembly, for example a portion of the airflow generated by the blower fan 6. The connection flange 15 can be in form of a wall adapted to cooperate with complementary connector of the external source. The connection flange 15 can constitute a liquid trap, for example collecting liquid dripping down the sides of the air supply channel of the external source. In this example, the connection flange 15 is on form of a closed ring encircling the air inlet 8.

Figure 6:
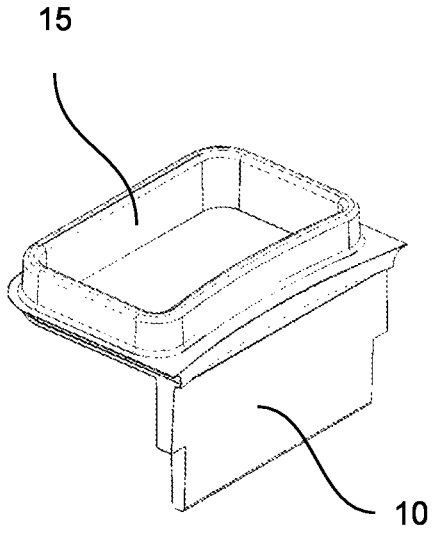
FIG. 6 shows a perspective view of an example of a connection flange.

FIG. 6 shows a perspective view of an example of a connection flange 15. The connection flange 15 can be in form of an insert attached within the air inlet 8. The first deflector wall 10 can protrude from the connection flange 15, i.e. be a part thereof.

Figure 7:
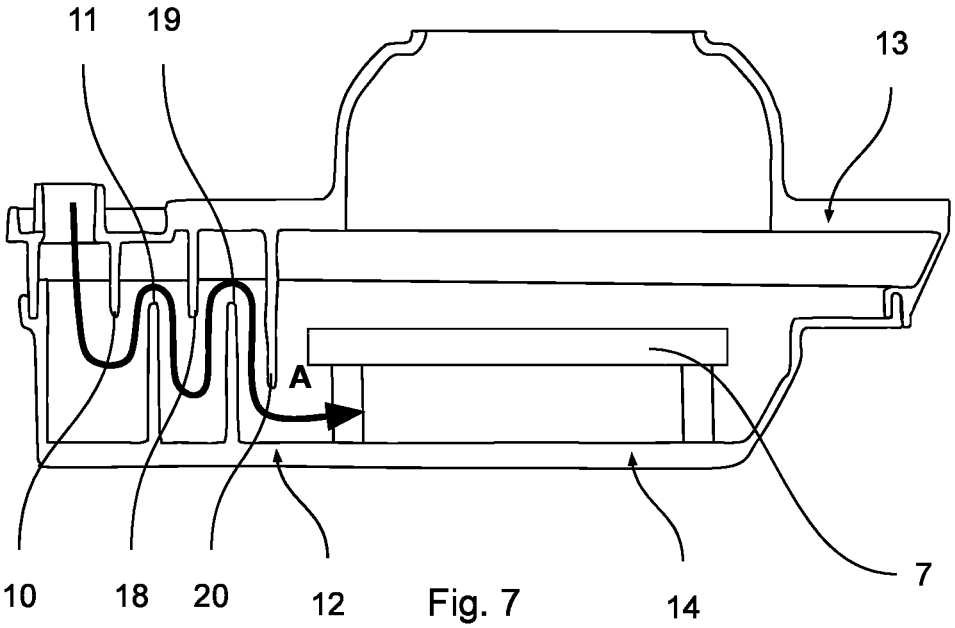
FIG. 7 shows a cross-sectional view of another embodiment of the blower device.

FIG. 7 shows a cross-sectional view of another embodiment of the blower device 1. In this embodiment, the bottom portion 12 and the first deflector wall 10 form a right angle. The blower device 1 includes a second liquid trap wall 19 extending within the air channel 9 and contributing to the meandering path for the airflow A. Preferably, the second liquid trap wall 19 protrudes from the second motor holder part 14.

The blower device 1 includes a third deflector wall 20 extending within the air channel 9 and contributing to the meandering path for the airflow A. Preferably, the third deflector wall 20 protrudes from the first motor holder part 13. Advantageously, the third deflector 20 wall is adjacent to the electronic circuit 7 and is protruding farther than the first deflector wall 10 so that the distance between the terminal end of the third deflector wall 20 and the bottom portion 12 is smaller than the distance between the electronic circuit 7 and the bottom portion 12. These distances can be measured along paths parallel to the rotation axis of the shaft 5 of the motor 4.

Figure 8:
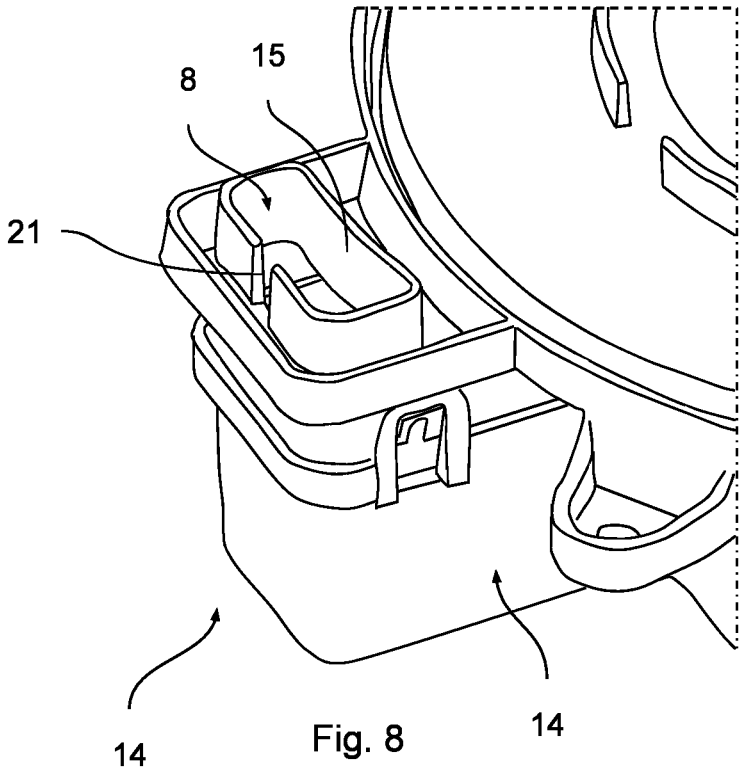
FIG. 8 a partial perspective view of the blower device of FIG. 7.

FIG. 8 a partial perspective view of the blower device of FIG. 7. In this embodiment, the connection flange 15 includes a drain slot 21 configured to allow liquid flow into the air channel 9, in particular from the liquid trap formed by the connection flange 15, in particular in form of large droplets. In particular, large droplets of water are easier to capture in liquid traps than small, lightweight droplets.

Besides the multi-blade configuration, the blower fan 6 may also be an axial-flow fan. The motor 4 of the blower device 1 can be a brushless motor.

The bottom portion 12 can include a drain opening within any liquid trap 22 in vicinity of the first liquid trap wall 11 and/or the second liquid trap wall 19 to enable evacuation of any trapped liquid outside of the blower device 1.

Other variations to the disclosed embodiments can be understood and effected by those skilled in the art in practicing the claimed invention, from a study of drawings, the disclosure, and the appended claims. The mere fact that certain measures are recited in mutually different dependent claims does not indicate that a combination of these measures cannot be used to the advantage.

The invention claimed is:

1. A blower device comprising:

a motor holder;

a motor housed within the motor holder;

a blower fan coupled to the motor;

an electronic circuit adapted to control the motor;

wherein the motor holder includes an air inlet and an air channel configured to supply the electronic circuit and the motor with an airflow from the air inlet, wherein the air channel includes a first deflector wall and a first liquid trap wall arranged in series between the air inlet and the electronic circuit, wherein the first deflector wall and the first liquid trap wall extend in opposite directions and form a meandering path for the airflow, wherein the air inlet includes a connection flange, wherein the connection flange includes a drain slot configured to allow liquid flow into the air channel.

2. The blower device according to claim 1, wherein the first deflector wall is situated upstream from the first liquid trap wall.

3. The blower device according to claim 1, wherein the air channel includes a bottom portion, the first liquid trap wall extending upwards from the bottom portion so as to form a liquid trap for liquid present in the airflow entering the air inlet.

4. The blower device according to claim 3, wherein the first deflector wall extends downwards from the motor holder, within the air channel, towards the bottom portion.

5. The blower device according to claim 3, wherein the bottom portion and the first deflector wall form an oblique angle.

6. The blower device according to claim 3, wherein the bottom portion and the first deflector wall form a right angle.

7. The blower device according to claim 3, wherein the motor holder includes a first motor holder part and a second motor holder part releasably attached to each other and both forming the air channel, the first motor holder part encapsulating the motor, wherein the bottom portion is part of the second motor holder part.

8. The blower device according to claim 1, wherein the connection flange is in form of an insert attached within the air inlet.

9. The blower device according to claim 8, wherein the first deflector wall protrudes from the connection flange.

10. The blower device according to claim 1, further comprising a second deflector wall extending within the air channel and contributing to the meandering path for the airflow.

11. The blower device according to claim 10, wherein the air channel includes a bottom portion, wherein the second deflector wall is adjacent to the electronic circuit and is protruding farther than the first deflector wall so that the distance between the terminal end of the first deflector wall and the bottom portion is smaller than the distance between the electronic circuit and the bottom portion.

12. The blower device according to claim 10, wherein the air channel includes a bottom portion, wherein the motor holder includes a first motor holder part and a second motor holder part releasably attached to each other, wherein the bottom portion is part of the second motor holder part, wherein the second deflector wall protrudes from the first motor holder part.

13. The blower device according to claim 1, further comprising a second liquid trap wall extending within the air channel and contributing to the meandering path for the airflow.

14. The blower device according to claim 13, wherein the air channel includes a bottom portion, wherein the motor holder includes a first motor holder part and a second motor holder part releasably attached to each other, wherein the bottom portion is part of the second motor holder part, wherein the second liquid trap wall protrudes from the second motor holder part.

15. The blower device according to claim 10, further comprising a third deflector wall extending within the air channel and contributing to the meandering path for the airflow.

16. The blower device according to claim 15, wherein the air channel includes a bottom portion, wherein the motor holder includes a first motor holder part and a second motor holder part releasably attached to each other, wherein the bottom portion is part of the second motor holder part, wherein the third deflector wall protrudes from the first motor holder part.

17. The blower device according to claim 15, wherein the air channel includes a bottom portion, wherein the third deflector wall is adjacent to the electronic circuit and is protruding farther than the first deflector wall so that the distance between the terminal end of the third deflector wall and the bottom portion is smaller than the distance between the electronic circuit and the bottom portion.

* * * * *